US010681996B2

(12) United States Patent
Forrest et al.

(10) Patent No.: US 10,681,996 B2
(45) Date of Patent: Jun. 16, 2020

(54) PLANAR DISPLAY ASSEMBLY

(71) Applicant: LIBERTY HARDWARE MFG. CORP., Winston-Salem, NC (US)

(72) Inventors: Earl David Forrest, Asheboro, NC (US); Ryan Patrick Martin, Kernersville, NC (US); James Allen Austin, III, High Point, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 116 days.

(21) Appl. No.: 15/803,172

(22) Filed: Nov. 3, 2017

(65) Prior Publication Data

US 2018/0125268 A1 May 10, 2018

Related U.S. Application Data

(60) Provisional application No. 62/419,691, filed on Nov. 9, 2016.

(51) Int. Cl.
*A47G 1/16* (2006.01)
*A47G 1/06* (2006.01)
(Continued)

(52) U.S. Cl.
CPC ..... *A47G 1/168* (2013.01); *A47F 7/0042* (2013.01); *A47G 1/02* (2013.01); *A47G 1/06* (2013.01);
(Continued)

(58) Field of Classification Search
CPC .. A47G 1/06; A47G 1/168; A47G 2001/0677; A47G 1/0616; A47F 7/0042
See application file for complete search history.

(56) References Cited

U.S. PATENT DOCUMENTS 27,592 A 3/1860 Cooper
908,608 A 1/1909 Pullen
(Continued)

FOREIGN PATENT DOCUMENTS

BR 1020120143917 A2 6/2014
CN 201589049 U 9/2010
(Continued)

OTHER PUBLICATIONS

Andscot Company, Inc., "Hang-It Brochure", 2 pages, Applicant Admitted Prior Art.
(Continued)

*Primary Examiner* — Eret C McNichols
(74) *Attorney, Agent, or Firm* — Brooks Kushman P.C.; Lora Graentzdoerffer

(57) ABSTRACT

A planar display assembly is provided with a planar display pane in a frame with apertures formed about a periphery. Base members have a post received within the apertures. A retaining wall with ratchet teeth extends from each base member. Latch members with a hoop portion with a slot receive each retaining wall for adjustment in a direction toward the frame to accommodate display panes of varying thicknesses. A tooth is formed in each latch member to engage the ratchet teeth for adjustment. A release tab is provided on each latch member for manual release of the tooth from the ratchet teeth. A flexible arm extends from each latch members to engage and retain the planar display pane within the frame.

20 Claims, 6 Drawing Sheets

(51) Int. Cl.
*A47G 1/02* (2006.01)
*A47F 7/00* (2006.01)

(52) U.S. Cl.
CPC .... *A47G 1/0616* (2013.01); *A47G 2001/0677* (2013.01)

(56) References Cited

U.S. PATENT DOCUMENTS

| | | | | |
|---|---|---|---|---|
| 1,354,270 | A | 9/1920 | Wood | |
| 2,181,874 | A | 12/1939 | Cross | |
| 2,469,923 | A | 5/1949 | Jones | |
| 2,489,477 | A * | 11/1949 | Brecher | A47G 1/06 40/792 |
| 2,668,032 | A * | 2/1954 | Haefner | A47G 1/06 52/126.3 |
| 2,696,962 | A | 12/1954 | Goss | |
| 2,744,346 | A * | 5/1956 | Auerbach-Levy | A47G 1/06 40/792 |
| 2,877,815 | A | 3/1959 | Fonken | |
| 3,208,876 | A | 9/1965 | Dodge | |
| 3,274,721 | A | 9/1966 | Dreyer | |
| 3,283,431 | A | 11/1966 | Pearlman | |
| 3,463,427 | A | 8/1969 | Fisher | |
| 3,471,111 | A | 10/1969 | MacDonald | |
| 3,471,112 | A | 10/1969 | MacDonald et al. | |
| 3,501,124 | A | 3/1970 | Goss | |
| 3,546,802 | A | 12/1970 | Preston | |
| 4,027,413 | A | 6/1977 | Moede | |
| 4,037,813 | A | 7/1977 | Loui et al. | |
| 4,053,132 | A | 10/1977 | Del Pozzo | |
| 4,432,523 | A | 2/1984 | Follows | |
| 4,557,457 | A | 12/1985 | Cockfield et al. | |
| 4,666,117 | A | 5/1987 | Taft | |
| 4,732,358 | A | 3/1988 | Hughes et al. | |
| 4,819,901 | A | 4/1989 | McDonald | |
| D301,413 | S | 6/1989 | Rosen | |
| 4,944,475 | A | 7/1990 | Ono et al. | |
| 4,991,329 | A | 2/1991 | Wilson | |
| 5,367,749 | A | 11/1994 | Takeuchi | |
| D364,055 | S | 11/1995 | Pakla | |
| 5,759,045 | A | 6/1998 | Gabig et al. | |
| 6,186,456 | B1 | 2/2001 | Marsh | |
| 6,286,802 | B1 | 9/2001 | Munson et al. | |
| 6,572,943 | B2 | 6/2003 | Shaffer | |
| D536,659 | S | 2/2007 | Panasewicz et al. | |
| 7,337,729 | B2 | 3/2008 | Briosi | |
| 7,967,400 | B1 | 6/2011 | Collum | |
| 8,468,767 | B1 | 6/2013 | McBride | |
| 8,495,830 | B2 | 7/2013 | Price | |
| D706,064 | S | 6/2014 | Ota et al. | |
| 9,027,766 | B1 | 5/2015 | Serotta et al. | |
| D758,771 | S | 6/2016 | Austin, III et al. | |
| D763,023 | S | 8/2016 | Austin, III et al. | |
| D799,862 | S | 10/2017 | Laumerich et al. | |
| 9,833,086 | B2 | 12/2017 | Forrest et al. | |
| 2002/0046477 | A1 * | 4/2002 | Bauer | A47G 1/0605 40/792 |
| 2002/0081409 | A1 | 6/2002 | Shaffer | |
| 2003/0038222 | A1 | 2/2003 | Holmes | |
| 2004/0074130 | A1 | 4/2004 | Chatterjea | |
| 2004/0221772 | A1 | 11/2004 | Narkis et al. | |
| 2005/0109910 | A1 | 5/2005 | Vander Berg et al. | |
| 2006/0218839 | A1 * | 10/2006 | Vineyard | A47G 1/06 40/796 |
| 2007/0069358 | A1 | 3/2007 | McAllister et al. | |
| 2007/0153375 | A1 | 7/2007 | Peterson et al. | |
| 2008/0023615 | A1 | 1/2008 | Scarcello | |
| 2008/0078916 | A1 | 4/2008 | Nevers et al. | |
| 2008/0216374 | A1 | 9/2008 | Ozmun | |
| 2008/0236053 | A1 | 10/2008 | Adams et al. | |
| 2008/0237434 | A1 | 10/2008 | Lin | |
| 2008/0251413 | A1 | 10/2008 | Blumenau-Bebry | |
| 2009/0294610 | A1 | 12/2009 | Paharik et al. | |
| 2010/0060807 | A1 | 3/2010 | Green et al. | |
| 2010/0140428 | A1 | 6/2010 | Vassallo | |
| 2010/0229442 | A1 | 9/2010 | Snow et al. | |
| 2010/0276562 | A1 | 11/2010 | Nguyen | |
| 2011/0266406 | A1 | 11/2011 | Westimayer et al. | |
| 2011/0271571 | A1 | 11/2011 | Lennard | |
| 2012/0030978 | A1 | 2/2012 | Miller | |
| 2012/0032062 | A1 | 2/2012 | Newville | |
| 2012/0144708 | A1 | 6/2012 | Schwartz | |
| 2012/0145847 | A1 | 6/2012 | Wang | |
| 2012/0222341 | A1 | 9/2012 | Tucker | |
| 2012/0260549 | A1 | 10/2012 | Andrulewich | |
| 2012/0306188 | A1 | 12/2012 | Chen | |
| 2013/0026319 | A1 | 1/2013 | Crescenzo | |
| 2013/0048812 | A1 | 2/2013 | Lozano | |
| 2013/0112637 | A1 | 5/2013 | Kuhn | |
| 2013/0180142 | A1 | 7/2013 | Kressin et al. | |
| 2013/0256476 | A1 | 10/2013 | Ripke | |
| 2013/0256487 | A1 | 10/2013 | Ko | |
| 2013/0269170 | A1 | 10/2013 | Goldberg | |
| 2013/0321715 | A1 | 12/2013 | Millson et al. | |
| 2013/0325670 | A1 | 12/2013 | Austin, III et al. | |
| 2014/0030490 | A1 | 1/2014 | Crosby et al. | |
| 2014/0231611 | A1 | 8/2014 | Svihilik | |
| 2014/0263923 | A1 | 9/2014 | McKinney | |
| 2014/0291460 | A1 | 10/2014 | Warncke et al. | |
| 2015/0071475 | A1 | 3/2015 | Hose et al. | |
| 2015/0075046 | A1 | 3/2015 | Skinner | |
| 2015/0269875 | A1 | 9/2015 | Corcoran et al. | |
| 2015/0272352 | A1 | 10/2015 | Chowdhury et al. | |
| 2015/0335152 | A1 | 11/2015 | Buettner | |
| 2016/0007742 | A1 | 1/2016 | Yang | |
| 2017/0105549 | A1 | 4/2017 | Forrest et al. | |
| 2017/0105554 | A1 | 4/2017 | Forrest et al. | |
| 2017/0224133 | A1 | 8/2017 | Martin et al. | |
| 2018/0199736 | A1 * | 7/2018 | Spiro | A47G 1/0605 |
| 2019/0014928 | A1 * | 1/2019 | Forrest | A47G 1/02 |

FOREIGN PATENT DOCUMENTS

| | | | | |
|---|---|---|---|---|
| CN | 201764226 | U | 3/2011 | |
| CN | 203857240 | U | 10/2014 | |
| CN | 204114511 | U | 1/2015 | |
| CN | 204141192 | U | 2/2015 | |
| DE | 9414896 | U1 * | 1/1996 | A47G 1/0605 |
| DE | 29907723 | U1 * | 6/2000 | A47G 1/0605 |
| DE | 102012100562 | A1 | 7/2013 | |
| FR | 2706002 | A1 * | 12/1994 | A47G 1/0605 |
| FR | 2817724 | A1 * | 6/2002 | A47G 1/0605 |
| GB | 428524 | A * | 5/1935 | A47G 1/102 |
| KR | 2020110007036 | U | 7/2011 | |
| KR | 2020120006811 | U | 10/2012 | |
| WO | WO-2005023064 | A1 * | 3/2005 | A47G 1/06 |

OTHER PUBLICATIONS

"Hangman® Wall Mounting Hardware", Ace Hardware, 3 pages, Applicant Admitted Prior Art.
"Decor Wonderland SSM13 Houston Modern Frameless Mirror", 6 pages, Applicant Admitted Prior Art.
"Rectangle Wall Mirror Frameless Beveled 24"×36", Hook Included", Amazon.com, 24 pages, Applicant Admitted Prior Art.
Design U.S. Appl. No. 29/573,002, entitled "Retail Display", filed Aug. 2, 2016, 33 pages.
U.S. Appl. No. 15/800,301, entitled "Planar Display Assembly", filed Nov. 1, 2017, 24 pages.
U.S. Appl. No. 15/800,315, entitled "Planar Display Assembly", filed Nov. 1, 2017, 23 pages.

* cited by examiner

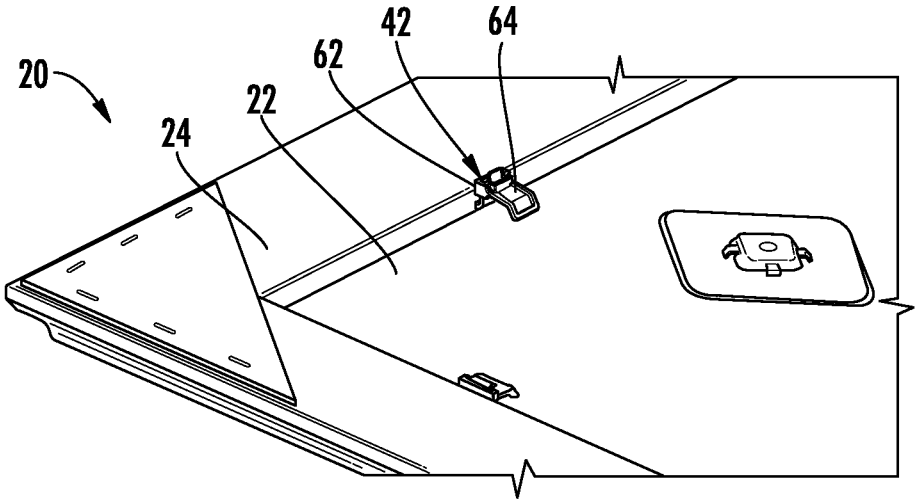
FIG. 3
FIG. 4
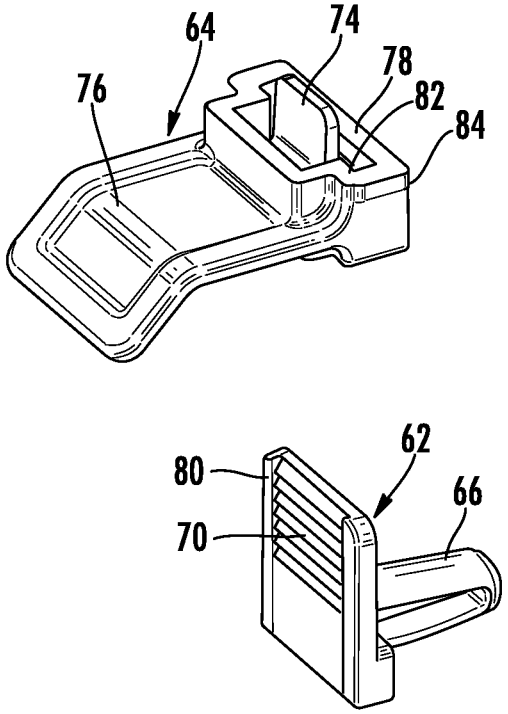

PLANAR DISPLAY ASSEMBLY

CROSS-REFERENCE TO RELATED APPLICATIONS

This application claims the benefit of U.S. provisional application Ser. No. 62/419,691 filed Nov. 9, 2016, the disclosure of which is hereby incorporated in its entirety by reference herein.

TECHNICAL FIELD

Various embodiments relate to frames and hardware for installing a planar display assembly to a frame.

BACKGROUND

Prior art planar display assemblies, such as mirror assemblies, offer preassembled mirror assemblies with or without a frame. Separate frames and mirror panes are also offered, which require a user to assemble the mirror to the frame, often utilizing various tools. Hardware is installed to mount the frame of a framed mirror assembly to an upright support surface. For unframed mirror assemblies, the hardware is installed to the mirror pane.

SUMMARY

According to at least one embodiment, a planar display assembly is provided with a planar display pane. A frame is sized to receive the planar display pane. A plurality of retainers mounts to the frame to retain the planar display pane within the frame. At least one of the plurality of retainers is adjustable in a direction toward the frame to engage and retain the planar display pane and to accommodate display panes of varying thicknesses.

According to another embodiment, a method for assembling a planar display assembly provides a frame. A planar display pane is inserted into the frame. A first fastener is installed into the frame. A second fastener is installed in cooperation with the first fastener to engage and retain the planar display pane within the frame.

According to another embodiment, a planar display assembly is provided with a planar display pane. A frame is sized to receive the planar display pane. The frame has a plurality of apertures formed about a periphery of the frame. A plurality of base members is provided, each with a post received within one of the plurality of frame apertures. A retaining wall extends from each base member away from the frame. A series of ratchet teeth are formed in each retaining wall. A plurality of latch members is each provided with a hoop portion with a slot sized to receive one of the plurality of retaining walls for adjustment in a direction toward the frame to accommodate display panes of varying thicknesses. A tooth is formed in each of the plurality of latch members and sized to engage a corresponding series of ratchet teeth for adjustment of each latch member along each retaining wall. A release tab is provided on each latch member in cooperation with a corresponding tooth for manual release of the tooth from the corresponding series of ratchet teeth. A flexible arm extends from each latch member to engage and retain the planar display pane within the frame. Each flexible arm is under tension when installed.

BRIEF DESCRIPTION OF THE DRAWINGS

FIG. 3 is another enlarged partial rear perspective view of the mirror assembly of FIG. 1;

FIG. 4 is an exploded perspective view of a retainer assembly of the mirror assembly of FIG. 1 according to an embodiment;

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional planar display assemblies, such as mirror assemblies, offer preassembled mirror assemblies with or without a frame. Separate frames and mirror panes are also offered, which require a user to assemble the mirror to the frame, often utilizing various tools. Hardware is installed to mount the frame of a framed mirror assembly to an upright support surface. For unframed mirror assemblies, the hardware is installed to the mirror pane. Dedicated hardware and tools are required for assembling and installing each mirror assembly, which requires significant efforts, components and costs to make any changes. Likewise, options for various combinations may be limited.

Figure 1:
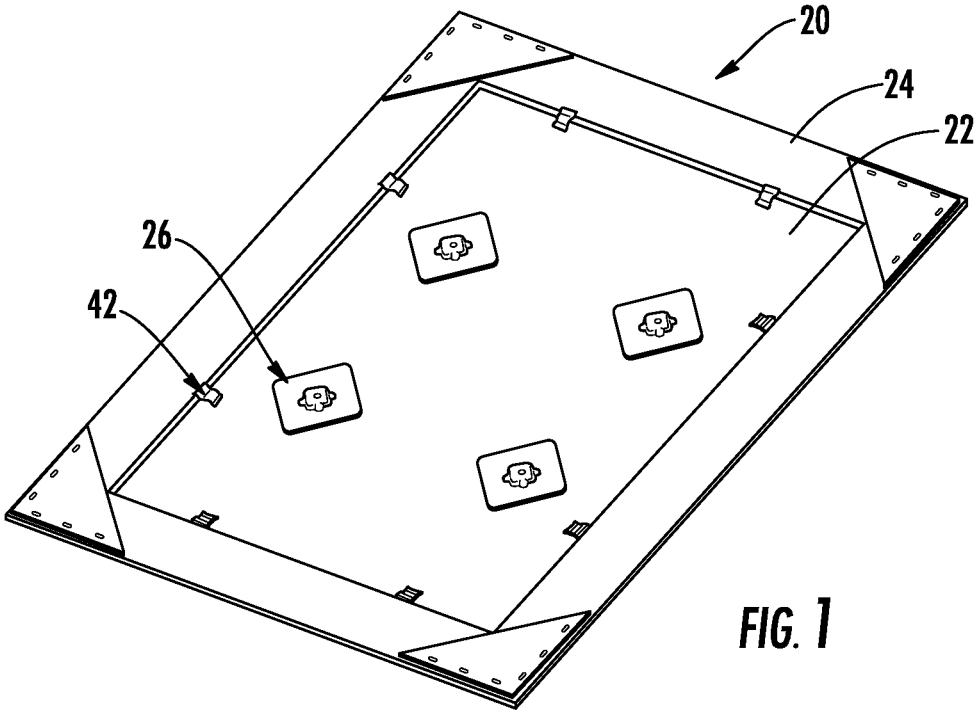
FIG. 1 is a rear perspective view of a mirror assembly according to an embodiment, illustrating an installation operation.

Referring now to FIG. 1, a customizable planar display assembly, such as a mirror assembly, is illustrated according to an embodiment, and referenced generally by numeral 20. Although the mirror assembly 20 is illustrated and described, any customizable planar display assembly is contemplated, such as a picture frame. The mirror assembly 20 is customizable in that it includes an interchangeable mirror pane 22 and frame 24.

The mirror assembly 20 provides standardized or common mounting and assembly hardware to offer ease in customer selection, customization, assembly, installations, modifications, replacements, and the like. The mirror pane 22 may be interchangeable with other mirror panes that have a common shape and size, but offer variations in style, such as deluxe glass, which may be clearer, have anti-fog treatment, a beveled perimeter edge, etching, and the like.

When a user desires a framed mirror assembly, a plurality of frames 24 is provided that is each sized to mount to the mirror pane 22. The varying frames 24 are offered in varying colors, finishes, ornamentation, widths, thicknesses and the like.

The mirror assembly 20 includes mounting hardware kits 26 that are common or standardized for mounting any of the mirror panes 22. The hardware kits 26 are illustrated and described in greater detail in Forrest et al. U.S. patent application Ser. No. 15/004,512, filed on Jan. 22, 2016, which published on Apr. 20, 2017 as U.S. Patent Application Publication No. US 2017/0105554 A1, which is incorporated in its entirety by reference herein.

FIG. 1 also illustrates a frame assembly hardware kit 42 according to an embodiment. The frame assembly hardware kit 42 is standardized for all of the frames 24 for commonality, interchangeability, modularity, replacement and reconfiguration of various combinations of frames 24 and mirror panes 22. For convenience, the frame assembly hardware kits 42 may be packaged with each of the frames 24. The frame assembly hardware kits 42 provide a simplified method of assembly for the securement of a mirror 22 or picture and backer to a decorative picture frame structure 24 without the need for any tools. These hardware kits 42 enable a consumer to purchase a mirror pane 22 separately from a frame 24, and then assemble the mirror assembly 20 prior to installation.

Figure 2:
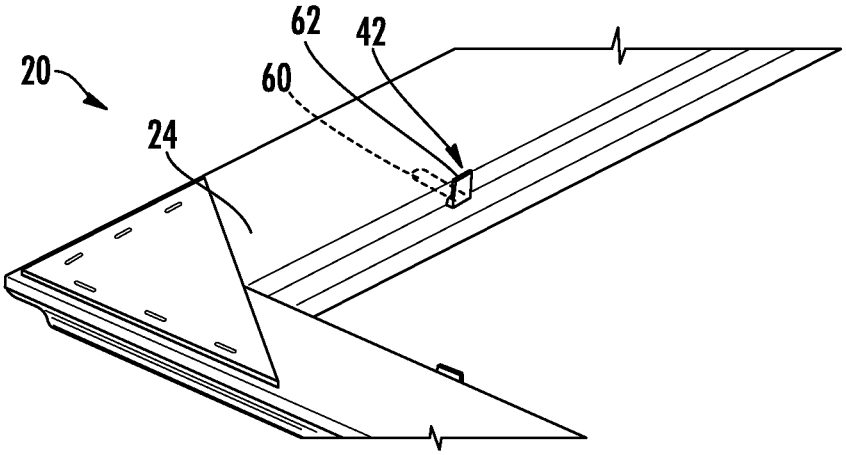
FIG. 2 is an enlarged partial rear perspective view of the mirror assembly of FIG. 1, illustrated partially assembled.
Figure 5:
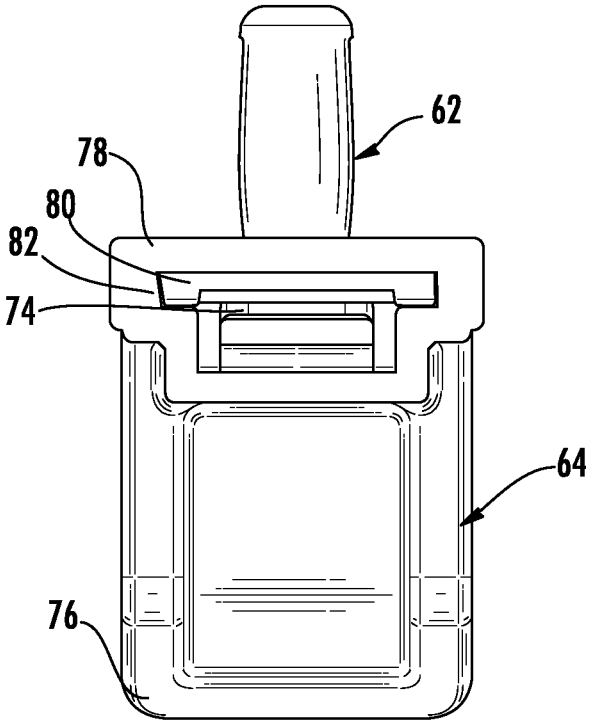
FIG. 5 is a rear elevation view of the retainer assembly of FIG. 4.

FIG. 2 illustrates the mirror assembly 20 partially disassembled without the mirror pane 22. The rectangular frame 24 includes a series of pre-drilled apertures 60 about an inner periphery such as an inner dado, for example eight apertures, with two formed in each molding member of the frame 24, adjacent an intersection with another molding member, and facing an opposed molding member. For oval frames, a similar aperture pattern is provided with two apertures in each quadrant, one of which faces a vertical direction, and the other faces a horizontal direction. The frame assembly hardware kits 42 include a plurality of retainer assemblies 42, which each include a first fastener or a polymeric base clip 62. The base clips 62 may be preinstalled by the manufacturer to ensure a proper fit and to relieve the consumer from performing this task.

FIG. 3 illustrates the mirror assembly 20 with the mirror pane 22 installed into the dado of the frame 24. After installation of the mirror pane 22, a second fastener or a polymeric latch clip 64 is attached to each base clip 62 of each retainer assembly 42. The latch clips 64 each overlap and engage the mirror pane 22 or a backing layer of the mirror pane 22, and collectively retain and secure the mirror pane 22 within the frame 24.

The retainer assembly 42 is illustrated disassembled in FIG. 4. The base clip 62 includes a post 66 for receipt within one of the apertures 60 of the frame 24. The latch clip 64 contains a single tooth 68 (FIG. 7) or a plurality of teeth or lug(s) which lock onto a saw tooth feature set 70 or ratchet, upon the base clip 62, for mirror 22 to frame 24 securement. The latch clip 64 also includes a release tab 74, which enables removal of the tooth 68 and thus enable the frame 24 or mirror 22 to be easily replaced when needed during a remodel project.

The base clip 62 and the latch clip 64 cooperate to hold the mirror 22 or picture within the frame 24 under spring tension. A flexible arm portion 76 of the latch clip 64 contacts the mirror 22 and retains the mirror 22 under elastic tension. A hoop portion 78 of the latch clip 64 provides a guide with a sliding fit for supporting the flexible arm portion 76, while retaining the latch clip 64 to secure the glass 22.

Figure 6:
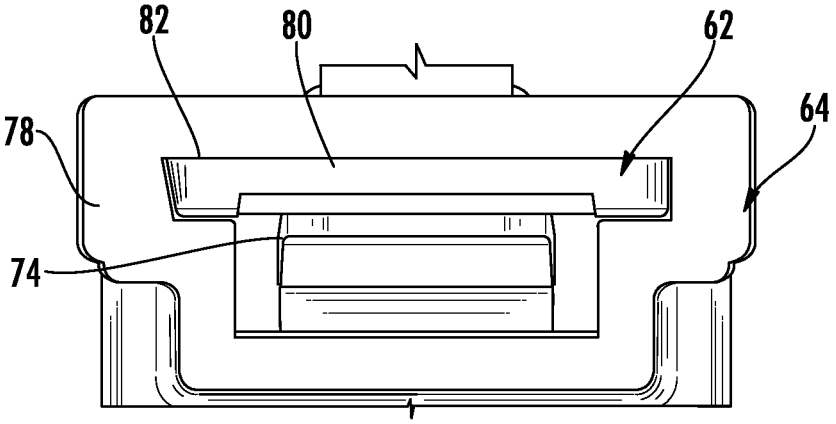
FIG. 6 is an enlarged partial rear elevation view of the retainer assembly of FIG. 4.

The base clip includes a retaining wall 80 supported by the post 66. The toothed ratchet surface 70 is provided on one side of the retaining wall. The retaining wall 80 is received within a slot 82 through the hoop portion 78. The slot 82 is illustrated in FIG. 6. The slot 82 and the retaining wall 80 are formed asymmetrically to permit only one assembly orientation. For example, the slot 82 and the retaining wall 80 each have a trapezoidal profile. These profiles prevent improper assembly of the latch clip 64 upon the base clip 62.

FIGS. 5-8 illustrate that the release tab 74 extends from the hoop portion 78 of the latch clip 64 into the slot 82. The tooth 68 upon the release tab 74 is biased into engagement with the ratchet surface 70.

Figure 7:
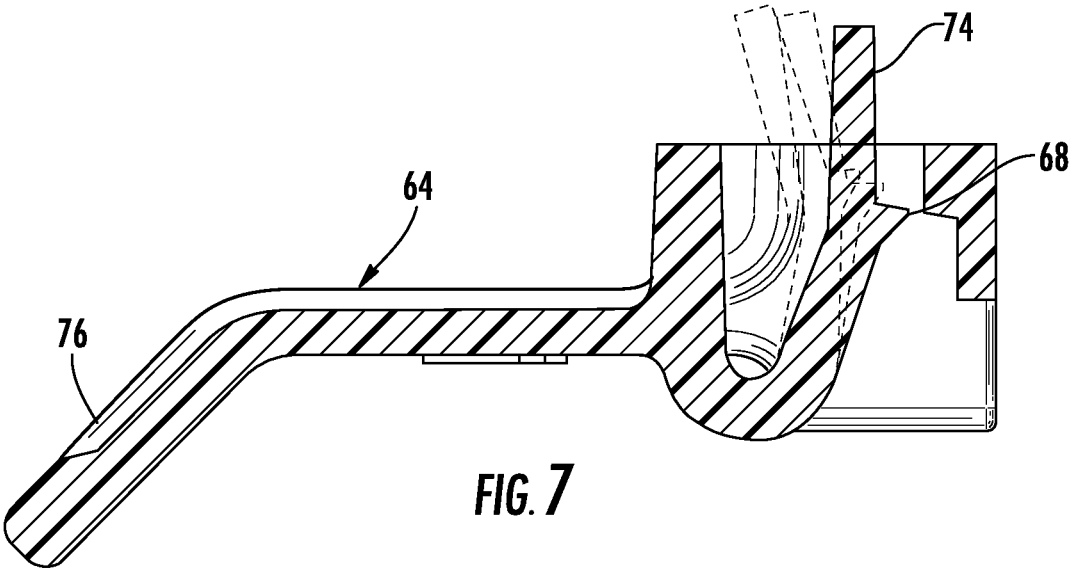
FIG. 7 is a side elevation section view of a fastener of the retainer assembly of FIG. 4.
Figure 8:
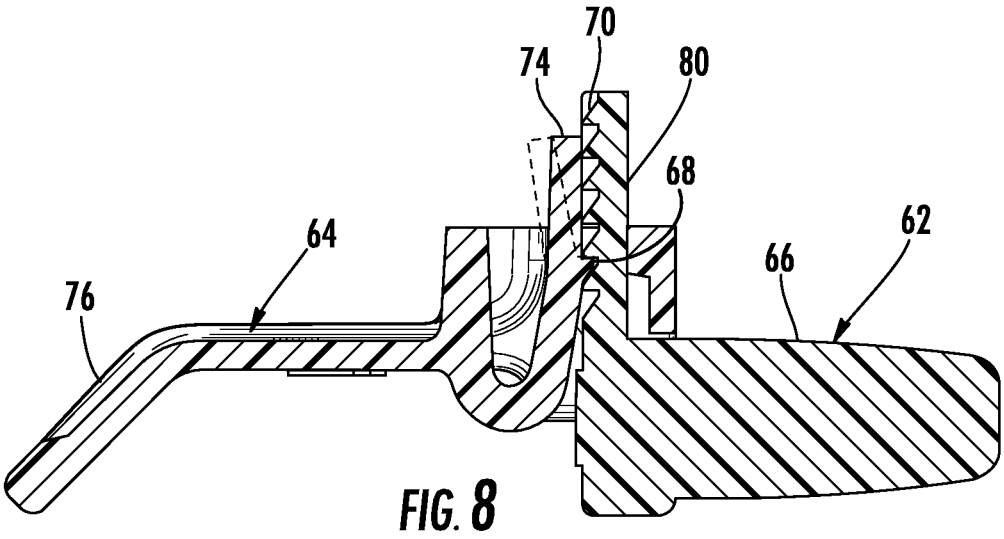
FIG. 8 is a side elevation section view of the retainer assembly of FIG. 4.

FIG. 7 depicts the flexible latching feature or release tab 74 of the latch clip 64 in three different positions. The unloaded position is tilted slightly forward so that the tab 74 extends into the slot 82 so that a leading edge of the tooth 68 intersects a path within the slot 82 for the retaining wall 80. An intermediate position represents a position wherein the tooth 68 is engaged with the ratchet surface 70 as illustrated in FIG. 8. In this position, the release tab 74 is elastically deformed out of the slot 82 to generate the spring tension within the release tab to maintain engagement of the tooth 68 with the ratchet surface. This bias or spring tension also provides an audible and tactile feel as the latch clip 64 is slid over the base clip 62.

Manual actuation of the release tab 74 to another position, away from the retaining wall 80, causes the tooth 68 to disengage from the ratchet surface 70. Removal or the adjustment of the latch clip 64 relative to the base clip 62 is thereby permitted. Referring again to FIG. 4, a pair of grip tabs 84 is provided on the hoop portion 78 to permit the user to pull the latch clip 64 from the base clip 62.

Figure 9:
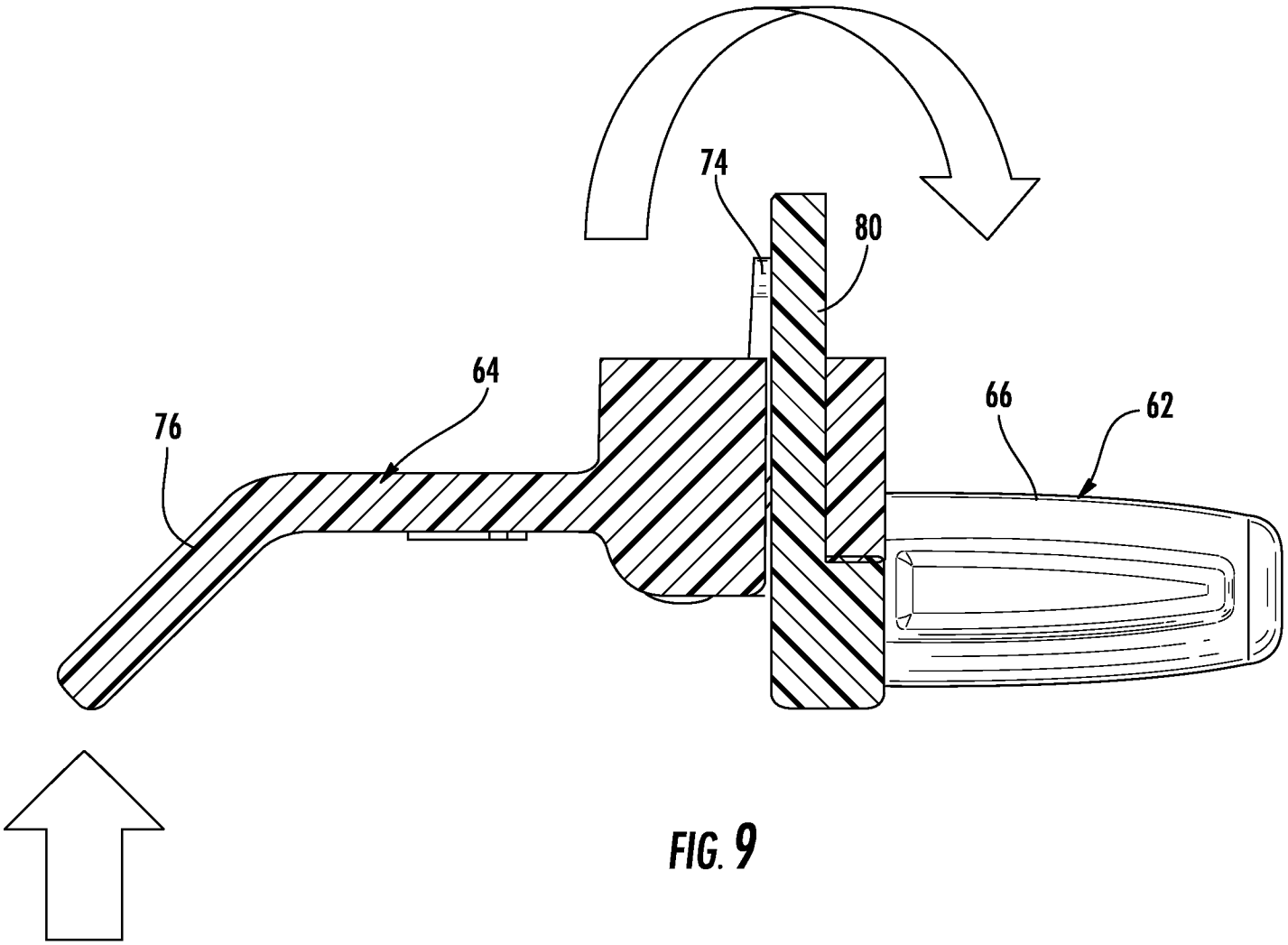
FIG. 9 is another side elevation section view of the retainer assembly of FIG. 4.

FIG. 9 depicts the points of contact once the latch clip 64 is engaged onto the base clip 62. Mirror glass, picture plate glass and backers vary in thickness based on common industry tolerances. The total thickness of this stack does not occur in convenient repeating increments that would allow for a rigid body latching mechanism to secure the thickness (three millimeters (mm), four mm, five mm, etc.). As an example, four mm mirror glass can vary in thickness by +/−0.20 mm. A rigid clip system 42 with secure increments of one mm might secure the glass well near the nominal tolerance and leave the glass loose at the tolerance extremes. Decreasing the increments below the one mm threshold increases critical tolerances on the clip system 42 without adding value to the consumer.

By making a portion 76 of the clip system 42 flexible, infinite thickness variations between the engagement teeth 68, 70 can be achieved. In the depicted embodiment, once the flex arm 76 first engages the glass or picture backer, a reaction force is exerted on the latch clip flex arm 76. Consequently, a moment is applied to the latch clip 64 until the hoop portion 78 touches the retaining wall 80 on opposed sides of the slot 82. After initial contact with the glass 22, pushing the latch clip 64 further down onto the base clip 62 allows the flex arm 76 to bend in response until the tooth 68 on the flexible latching feature 74 engages the next available tooth in the ratchet 70. Once a plurality of these clip assemblies 42 are installed within frame 24, the mirror 22 or picture and backer is contained within the frame 24 under spring tension.

Figure 10:
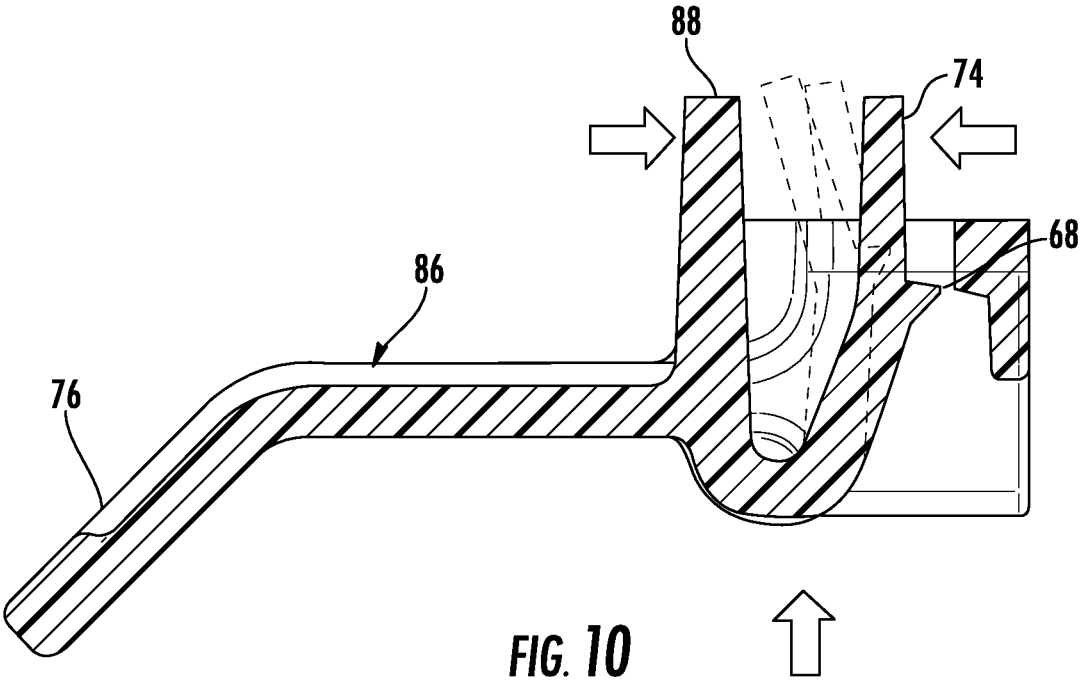
FIG. 10 is a side elevation section view of a fastener of a retainer assembly according to another embodiment.
Figure 11:
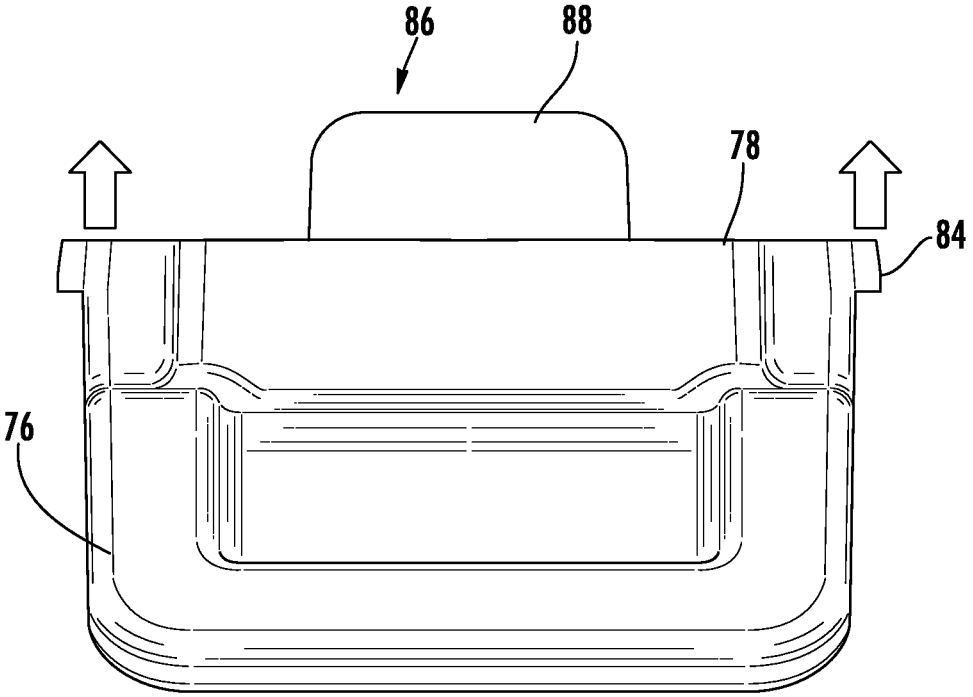
FIG. 11 is a top plan view of the fastener of FIG. 10.

FIGS. 10 and 11 illustrate a latch clip 86 according to another embodiment. The latch clip 86 is similar to the prior embodiment. However, the latch clip 86 includes an additional support wall 88. A removal method permits a consumer to exert a pinching force (at opposed arrows) onto the release tab 74 and the support wall 88 to pivot the release tab 74 to an unlatched position. Once in this position the latch clip 86 can be lifted from the base clip 62 while maintaining the pinch force, without requiring another hand to grasp the latch clip 86 at another location.

The various embodiments also provide methods which include a plurality of precisely placed factory drilled holes within the frame 24 extrusion that allows the consumer to insert a series of polymeric base clips 62 by which a mirror 22 or a picture, glass and backer might be installed. Alternatively, the base clips 62 might be installed at the frame factory. A method to flexibly and adjustably attach mirror glass 22 or a picture and backer into a decorative frame 24 containing a dado and a plurality of apertures 60 accepts a base clip 62. Once the base clips 62 are secured to the frame 24, the glass 22 can be placed within the dado of the frame 24. The proximity of the mirror 22 compared to the installed base clips 62 helps to prevent the base clips 62 from backing out of the predrilled apertures 60. The latch clip 64 contains a hoop portion 78 and a flex arm latch portion 76 into a single injection molded component. Adding a flexible release latch 74 permits the consumer to reversibly attach the latch clip 64 to the base clip 62. Various methods of release are permitted as demonstrated in FIGS. 7-11.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A planar display assembly comprising:

a planar display pane;

a frame sized to receive the planar display pane; and a plurality of retainers mounted to the frame to retain the planar display pane within the frame, wherein at least one of the plurality of retainers is adjustable in a direction toward the frame to engage and retain the planar display pane and to accommodate display panes of varying thicknesses, wherein the adjustable retainer further comprises:

a base member mounted to the frame, wherein the base member further comprises a retaining wall extending away from the frame, and a latch member adjustably mounted to the base member, wherein the latch member further comprises a hoop portion with a slot sized to receive the retaining wall for translation of the latch member along the retaining wall.

2. The planar display assembly of claim 1 wherein the frame has a plurality of apertures formed about a periphery of the frame; and wherein the adjustable retainer further comprises a post sized to be received within one of the plurality of apertures.

3. The planar display assembly of claim 1 wherein the base member has a length extending in a direction away from the planar display pane and the latch member is adjustable along the length of the base member.

4. The planar display assembly of claim 3 wherein the base member comprises at least one ratchet component; and the latch member comprises at least another ratchet component in engagement with the at least one ratchet component of the base member.

5. The planar display assembly of claim 3 wherein the base member comprises a series of teeth; and wherein the latch member comprises at least one tooth engaged with the series of teeth of the base member.

6. The planar display assembly of claim 1 wherein the latch member is lockable relative to the base member.

7. The planar display assembly of claim 1 wherein the latch member further comprises a release tab for manual release of the latch member from the base member.

8. The planar display assembly of claim 7 wherein the latch member further comprises a support wall spaced apart from the release tab to provide a reaction force to a manual grip applied upon the release tab.

9. The planar display assembly of claim 1 wherein the latch member further comprises a flexible arm portion extending from the latch member to engage the planar display pane.

10. The planar display assembly of claim 9 wherein the latch member cooperates with the base member such that the flexible arm portion is under tension when installed in engagement with the planar display pane.

11. The planar display assembly of claim 1 wherein the base member further comprises a base guide member; and wherein the latch member further comprises a latch guide member sized to cooperate with the base guide member in only one assembled orientation to prevent improper assembly.

12. The planar display assembly of claim 11 wherein the base guide member is formed with an asymmetric profile and the latch guide member is formed with a cooperative asymmetric profile to permit the assembled orientation and to prevent improper assembly orientations.

13. The planar display assembly of claim 1 wherein the base member further comprises a series of ratchet teeth formed in the retaining wall; and wherein the latch member further comprises at least one tooth sized to engage the series of ratchet teeth for adjustment of the latch member along the retaining wall.

14. The planar display assembly of claim 1 wherein the retaining wall is formed asymmetrically, and the slot is formed asymmetrically to permit only one assembly orientation and to prevent improper assembly.

15. The planar display assembly of claim 1 wherein the latch member further comprises a pair of grip tabs extending from opposed sides of the hoop portion to permit manual adjustment of the latch member along the base member.

16. A planar display assembly comprising:

a planar display pane;

a frame sized to receive the planar display pane, wherein the frame has a plurality of apertures formed about a periphery of the frame;

a plurality of base members, each with a post received within one of the plurality of frame apertures;

a retaining wall extending from each base member away from the frame;

a series of ratchet teeth formed in each retaining wall;

a plurality of latch members, each with a hoop portion with a slot sized to receive one of the plurality of retaining walls for adjustment in a direction toward the frame to accommodate display panes of varying thicknesses;

a tooth formed on each latch member and sized to engage a corresponding series of ratchet teeth for adjustment of each latch member along each retaining wall;

a release tab provided on each latch member in cooperation with a corresponding tooth for manual release of the tooth from the corresponding series of ratchet teeth; and a flexible arm extending from each latch member to engage and retain the planar display pane within the frame, whereby each flexible arm is under tension when installed.

17. A planar display assembly comprising:

a planar display pane;

a frame sized to receive the planar display pane; and a plurality of retainers mounted to the frame to retain the planar display pane within the frame, wherein at least one of the plurality of retainers is adjustable in a direction toward the frame to engage and retain the planar display pane and to accommodate display panes of varying thicknesses, wherein the adjustable retainer further comprises:

a base member mounted to the frame, and a latch member adjustably mounted to the base member;

a retaining wall extending from the base member or the latch member; and a hoop portion with connected to the base member or the latch member, with a slot sized to receive the retaining wall for translation relative to the retaining wall.

18. The planar display assembly of claim 17 wherein the base member further comprises a series of ratchet teeth formed in the retaining wall; and wherein the latch member further comprises at least one tooth sized to engage the series of ratchet teeth for adjustment of the latch member along the retaining wall.

19. The planar display assembly of claim 17 wherein the retaining wall is formed asymmetrically, and the slot is formed asymmetrically to permit only one assembly orientation and to prevent improper assembly.

20. The planar display assembly of claim 17 wherein the latch member further comprises a pair of grip tabs extending from opposed sides of the hoop portion to permit manual adjustment of the latch member along the base member.

* * * * *